US010174461B2

(12) United States Patent
Lichtberger

(10) Patent No.: US 10,174,461 B2
(45) Date of Patent: Jan. 8, 2019

(54) METHOD FOR CALIBRATING A DEVICE FOR MEASURING TRACKS

(71) Applicant: System 7—Railsupport GmbH, Vienna (AT)

(72) Inventor: Bernhard Lichtberger, Pregarten (AT)

(73) Assignee: HP3 Real GmbH, Vienna (AT)

( * ) Notice: Subject to any disclaimer, the term of this patent is extended or adjusted under 35 U.S.C. 154(b) by 0 days.

(21) Appl. No.: 15/319,760

(22) PCT Filed: Dec. 10, 2015

(86) PCT No.: PCT/AT2015/050313

§ 371 (c)(1),
(2) Date: Dec. 17, 2016

(87) PCT Pub. No.: WO2016/090401

PCT Pub. Date: Jun. 16, 2016

(65) Prior Publication Data

US 2017/0268180 A1 Sep. 21, 2017

(30) Foreign Application Priority Data

Dec. 12, 2014 (AT) ..... A 50901/2014

(51) Int. Cl.
*E01B 35/08* (2006.01)
*B61K 9/08* (2006.01)
*E01B 33/00* (2006.01)

(52) U.S. Cl.
CPC ..... *E01B 35/08* (2013.01); *B61K 9/08* (2013.01); *E01B 33/00* (2013.01)

(58) Field of Classification Search
CPC . B61K 9/08; E01B 35/08; E01B 35/10; E01B 33/00
See application file for complete search history.

(56) References Cited

U.S. PATENT DOCUMENTS 4,655,142 A * 4/1987 Theurer ..... E01B 27/17 104/7.1
4,691,565 A * 9/1987 Theurer ..... E01B 35/00 33/287

(Continued)

FOREIGN PATENT DOCUMENTS

DE 4102871 A1 8/1991
EP 0652325 A2 10/1995
GB 2240571 A 7/1991

*Primary Examiner* — David A Rogers
(74) *Attorney, Agent, or Firm* — Tiajoloff & Kelly LLP

(57) ABSTRACT

A method for calibrating a device for measuring tracks having a track-driveable track-measuring car with a lifting and lining device and track-position measurement sensors measuring the height, direction and superelevation of the rails of the track using the machine frame as a reference zero line. A lifting and lowering device is associated with the track-measuring car. A calibration device is associated with the machine frame the track-measuring car, for calibrating the sensors, is first lowered from a parking position, in which the track-measuring car is lifted from the track, onto the track or into an intermediate position. Calibration stops are moved by an actuator from an idle position into a calibration position, against which the track-measuring car is subsequently raised and applied. The values of the track-position measurement sensors are read out and stored in the measurement system as calibration values, and the track-measuring car is lowered onto the track.

6 Claims, 3 Drawing Sheets

(56) References Cited

U.S. PATENT DOCUMENTS 5,172,637 A * 12/1992 Theurer ..... E01B 27/20 104/7.1
5,199,176 A * 4/1993 Theurer ..... B61K 9/08 33/1 Q
5,481,982 A 1/1996 Theurer et al.
5,493,499 A * 2/1996 Theurer ..... E01B 35/00 342/357.34
6,154,973 A * 12/2000 Theurer ..... E01B 27/17 104/12
6,220,170 B1 * 4/2001 Theurer ..... E01B 33/00 104/10
6,546,876 B2 * 4/2003 Theurer ..... E01B 27/17 104/7.1
6,976,324 B2 * 12/2005 Theurer ..... E01B 35/06 104/7.3
7,050,926 B2 * 5/2006 Theurer ..... G01S 17/88 33/287
8,844,149 B2 * 9/2014 Madderom ..... E01B 35/00 33/338
9,441,956 B2 * 9/2016 Kainer ..... B61K 9/08
9,631,325 B2 * 4/2017 Lichtberger ..... E01B 27/17
9,683,883 B2 * 6/2017 Rettig ..... G01G 19/047
2003/0089530 A1 * 5/2003 Paine ..... G01G 19/047 177/163
2006/0000290 A1 * 1/2006 Otto ..... B61K 9/08 73/798
2008/0304083 A1 * 12/2008 Farritor ..... B61K 9/08 356/614
2010/0318246 A1 * 12/2010 Bieker ..... B61K 9/08 701/19
2011/0234451 A1 * 9/2011 Bock ..... B61L 3/125 342/109
2014/0151460 A1 * 6/2014 Noffsinger ..... B61C 15/10 239/69
2014/0313503 A1 * 10/2014 Bennett ..... G01S 17/42 356/28
2014/0325857 A1 * 11/2014 Madderom ..... B61K 9/08 33/301
2016/0082991 A1 * 3/2016 Warta ..... B61L 23/042 246/167 R
2017/0029001 A1 * 2/2017 Berggren ..... B61K 9/08
2017/0080960 A1 * 3/2017 Moeller ..... B61L 23/047

* cited by examiner

METHOD FOR CALIBRATING A DEVICE FOR MEASURING TRACKS

FIELD OF THE INVENTION

The invention relates to a method for calibrating a device for measuring tracks, comprising at least one track-driveable track-measuring car associated with a lifting and lining device, and comprising track-position measurement sensors for measuring the height position, the direction and the superelevation of the rails of the track using the machine frame as a reference zero line, wherein a measuring-car lifting and lowering device is associated with the track-measuring car. A device for measuring tracks with a calibration device is further proposed.

DESCRIPTION OF THE PRIOR ART

Track tamping machines are machines for correcting the track position. Measuring systems are used for this purpose, which systems measure the actual track height position and the actual track direction position and the actual superelevation position of the track during work. The track grid is lifted and laterally aligned by means of a track lifting/track lining unit and fixed in this position by means of a track tamping unit by compacting the ballast beneath the railway ties by means of a track tamping unit. The measured actual track position values are compared with the track position target values which are calculated by a track-geometry master computer on the basis of target track position schematics of the railway administration and are used for controlling and regulating the track lifting/track lining apparatus. The lifting and lining of the track grid occurs via respective hydraulic lifting and lining cylinders with proportional or servo control.

Measuring systems which use steel cords or optical measuring systems are conventionally used. Steel cords are usually tensioned between three measuring cars, wherein the middle car carries a standard value transducer which is deflected by the cord. Since tamping units which are also necessary for compacting the track are situated in the vicinity of said measuring transducer, the cord often forms an obstruction in the tight curve. In order to ensure that the tamping units do not come into conflict with the cord, the cords are often mechanically laterally deflected at the tension points and the thus produced measurement error is electronically compensated. So-called levelling cords are tensioned over both rails for measuring the height position of the tracks. The two measuring points above the rails are mostly scanned via angle sensors (levelling transducers). The levelling cords must be arranged at the top because the tamping units and the undercarriages of the tamping machines are in the way in the bottom region. Said levelling cords are drawn as far as the cabins of the tamping units. Inclinometers are installed on the measuring cars in order to detect the transverse inclination of the track.

The measured deflections by the levelling transducers, standard value transducers and superelevation transducers are converted into an electrical proportional signal. For the purpose of controlling the track tamping machine, the quantities of scale factor (e.g. mV/mm or mA/mm) and absolute zero position of the transducers are highly important for each of the transducers for their precision. Absolute calibration is necessary in order to detect these values. Absolute calibration means the calibration in this case with respect to a straight reference line by determining the zero value of the transducers. This is necessary because inaccuracies occur as a result of the constructive design. Such inaccuracies are the result of constructive mechanical tolerances, imprecise mounting, mechanical play, errors in the measuring train etc.

The problem is the zero calibration of the transducers. The ideal case will be explained below. In the case of an ideal straight track, the measuring cars of the lining unit are pressed transversely to the longitudinal direction of the track against one side of a rail, wherein the zero point of the transducer is determined subsequently. It is also necessary to calibrate the opposite side for the lining unit. The measuring car would be pressed for this purpose on an ideal track (ideal track: both rails form an ideal straight line with equal distance and are situated precisely in a horizontal plane) against the other rail and the zero point for said other side would be determined. The reason for this lies in the fact that the direction of the track is always predetermined by the rail on the outside of the curve because the train is guided along the rail on the outside of the curve. The necessity of zero calibration on both sides for the standard value transducer is necessitated by different mechanical plays, different track gauges of the measuring cars and different electronic measuring sections etc.

There is no ideal track however. A track contains longitudinal level errors, superelevation errors, twists, directional errors and track gauge errors. In addition, there are different depressions of the track under load. A so-called "zero track" is therefore required for the absolute zero calibration of a track. For this purpose, a track section of at least the length of the measuring system to be calibrated is sought which has the lowest number of potential track position errors of the type as described above. Since the required calibration precisions lie beneath 1 mm, real tracks are inadequate for this purpose. Prior to the actual calibration, the real track position must be measured precisely by means of geodetic measuring instruments or by other methods (string cord). The track tamping machine then travels onto this track. The track errors determined by means of geodetic methods or measured by means of other methods are now compensated by means of the spacers beneath the measuring wheels for the height or between the wheel flange and the rail. Zero calibration is then carried out. The measurement of the track position usually occurs on a real track without loading. The loading by the track tamping machine can lead to unknown deflections of the rail and the track grid, which impairs the precision of the calibration. A track solidly embedded in concrete is more reliable, which usually cannot be found on the open track. The employed zero calibration methods are therefore expensive, time-consuming, relatively imprecise and can only be carried out by qualified specialised staff. Verification of the measurement system on the open track by the machine operator is virtually impossible.

SUMMARY OF THE INVENTION

The invention is based on the object of providing a calibration apparatus of the kind mentioned above which avoids inaccuracies and allows simple and rapid calibration.

This object is achieved in accordance with the invention in such a way that a calibration device associated with the machine frame is provided, wherein the track-measuring car, for the purpose of calibrating the track-position measurement sensors, is first lowered from a parking position, in which the track-measuring car is lifted from the track, onto the track or into an intermediate position, whereupon calibration stops are moved by an actuator from an idle position into a calibration position, against which calibration stops the track-measuring car is subsequently raised and applied, whereupon the resulting values of the track-position measurement sensors are read out and are read into the measurement system and stored as calibration values, whereupon the track-measuring car is lowered onto the track, and whereupon optionally the calibration stops are moved by means of the actuator from their calibration position into their idle position.

The machine frame forms the absolute zero reference in accordance with the invention. Calibration stops which can be displaced via hydraulic calibration cylinders from an idle position to a calibration position are provided on the machine frame for the measuring car, of which there are usually three. The calibration stops are arranged to the left and the right, i.e. on both sides, on the machine frame in the region of the measuring car and are especially adjustable with respect to their height position. These calibration stops are precisely calibrated after the completion of the machine and set via adjusting devices. Prior to the zero calibration, the machine operator moves the track tamping machine to a relatively flat straight track in order to prevent twisting of the machine frame. The measuring cars are then lowered to a lower position for the absolute zero calibration of the measuring system (e.g. placed on the rails). The calibration stops are then moved from their idle position to their calibration position. The measuring cars are then lifted and pressed against the calibration stops with a defined amount of force. The track rollers of the measuring car are especially pressed against the associated calibration stops. The resulting sensor values are read out and stored in a measuring system. This measuring system usually comprises a computer unit with associated memory for evaluating the measured data.

It is especially recommended if the track measuring car, in the calibrating position, is pressed at first in one step on one machine frame side in the direction of a transverse axis of the track-measuring car via a pressing apparatus with the wheel flange against the associated calibration stop, and the resulting value on the standard value measuring sensor and the levelling value measuring sensor is read into and stored in the measuring system as a zero calibration value for this machine frame side, and if the track-measuring car is subsequently pressed in a second step onto the other opposite machine frame side in the opposite direction of the transverse axis of the track-measuring car via the pressing apparatus with the wheel flange against the associated calibration stop and the resulting value on the standard value measuring sensor is read into and stored in the measuring system as a zero calibration value for this machine frame side. The track rollers of the respective measuring car are therefore pressed at first on one machine side against the calibration stops. The zero calibration occurs for this side for the direction. Since the measuring wheels are cylindrical, the calibration of the levelling transducer can occur simultaneously. After the re-pressing of the measuring wheels against the opposite stops on the other machine side, the zero calibration of the standard value transducer occurs for this side. After lowering the measuring car onto the track, the calibration stops are pivoted out again. The actual superelevation measured value which is measured during the calibration on the measuring car is associated with the value of the reference superelevation measured value which is measured on the machine frame.

The method steps are preferably carried out by a control program in an automated manner.

The avoidance of the necessity of a "zero track" for calibration and the possibility of the automated, rapid, absolute and precise zero calibration of the measurement system on a relatively flat track section are the advantages of this embodiment in accordance with the invention. The zero calibration can be carried out by the machine operator on site. The entire measurement sequence can occur in an automated manner. As a result, the functionality of the measurement system and its precision can be checked rapidly prior to the commencement of the work of the construction site. Further advantages are provided in such a way that no personnel is required to move onto the track for calibration because this would otherwise cause hazards by trains on the adjoining track. The invention offers considerable cost-saving potentials and increases the functional reliability of the track tamping machine.

BRIEF DESCRIPTION OF THE DRAWINGS

The subject matter of the invention is shown in the drawings by way of example, wherein.

DESCRIPTION OF THE PREFERRED EMBODIMENT

Figure 1:
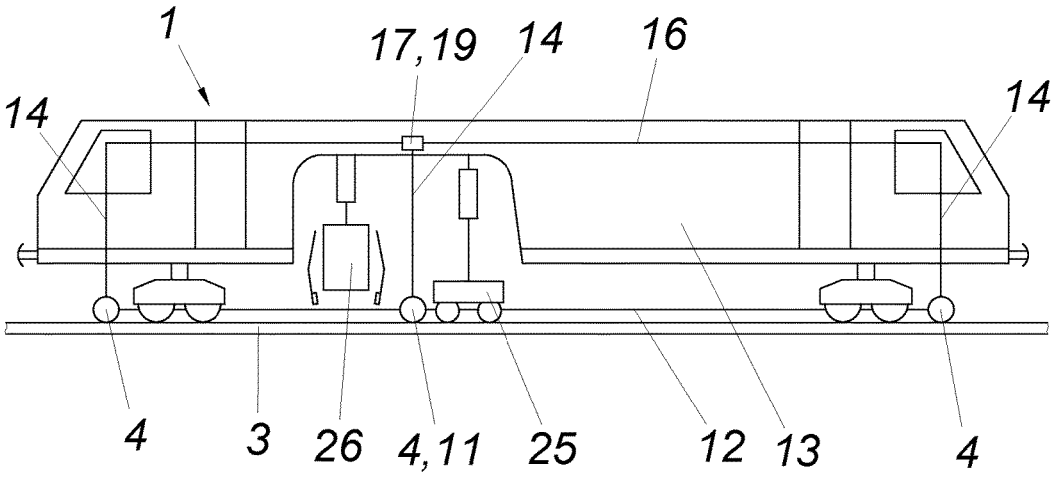
FIG. 1 shows a track tamping machine with a track tamping unit, a track lifting/lining unit, a levelling measurement system and a track lining measurement system in a side view.

A track tamping machine 1 (FIG. 1) comprises a tamping unit 26 and a track lifting/lining unit 25. The machine frame 13 is used as a reference for absolute zero calibration. The lining unit consists of a lining steel cord 12, the three measuring cars 4 and a lining transducer 11. The levelling unit consists of two steel cords 16 which are tensioned over the rails, two levelling transducers 17 with steel cord acquisition sensors 19 and the levelling rods 14. The track tamping machine 1 travels on undercarriages on the rails 3.

Sensors for measuring the height position (levelling transducers 17), the direction (lining transducers 11), and the superelevation (inclinometers 25) are provided as track position measurement sensors for measuring the rails of a track (3, 28). The track-measuring car 4 is associated with a measuring-car lifting and lowering apparatus 9.

Figure 2:
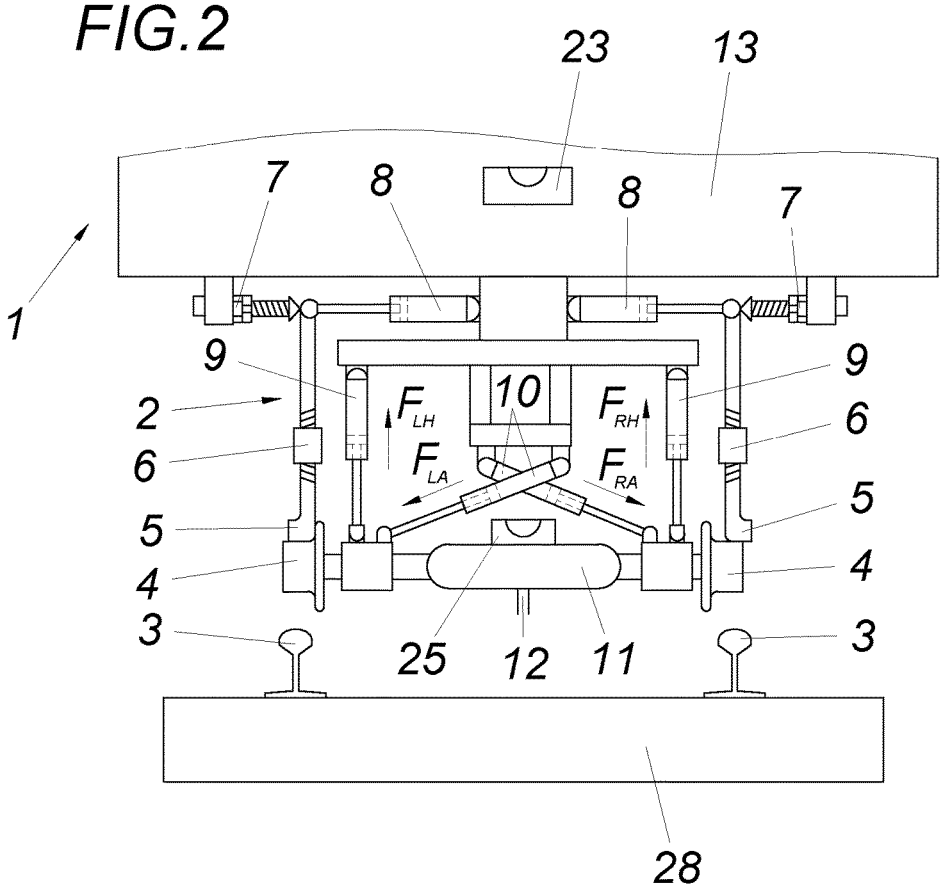
FIG. 2 shows an illustration in accordance with the invention of the calibration device with the measuring car in a cross-sectional view.

The machine frame 13 is associated with a calibration apparatus 2 with calibration stops 5, which can be moved onto the track from a parking position lifted from the track or a track-measuring car 4 lowered to an intermediate position for calibrating the track position measurement sensors with an actuator from an idle position to a calibration position, and against which the track-measuring car 4 can subsequently be lifted and applied. The calibration stops 5 form the attachment points for the measuring car applied with the measuring-car lifting apparatus 9 against the calibration stops 5 (FIG. 2).

In the case of an embodiment of the absolute calibration device 2 in accordance with the invention (FIG. 2), the machine frame 13 is used as a related reference. Calibration stops 7, which are adjustable in alignment in the longitudinal direction, are attached to the machine frame (adjustment via a thread and fixed via lock nuts for example). The calibration levers with the calibration stops 5 are pivoted inwardly or outwardly up to said stops via hydraulic calibration cylinders 8, i.e. they are displaced from their idle position to their calibration position. The height position of the calibration stop 5 can be adjusted via an adjusting device 6 (a threaded tube which connects the upper and bottom lever arm via a thread, wherein a left-hand thread is situated at the top for example and a right-hand thread at the bottom). The measuring wheel 4 is pressed upwardly via the measuring-car lifting cylinders 9 and the pressing cylinders 10 to the side against the respective calibration stop 5. A lining transducer 11 is attached to the measuring car, which lining transducer measures the lateral position of the lining cable 12 via a carrier. An inclinometer 25 is also disposed on the measuring car. A reference inclinometer 23 is disposed on the machine frame 13 as a reference for said inclinometer. In order to perform pressing to the left, both measuring-car lifting cylinders are switched to "lifting" (force $F_{LH}$ and $F_{RH}$ acting in the upward direction), and the pressing cylinder is switched to left action to pressing (force $F_{LA}$) and the pressing cylinder to the right is switched to powerless mode. For calibrating the right side, the right pressing cylinder is pressurised (force $F_{RA}$) and the left is switched to powerless mode. The rails 3 are mounted on the track ties 28.

Figure 3:
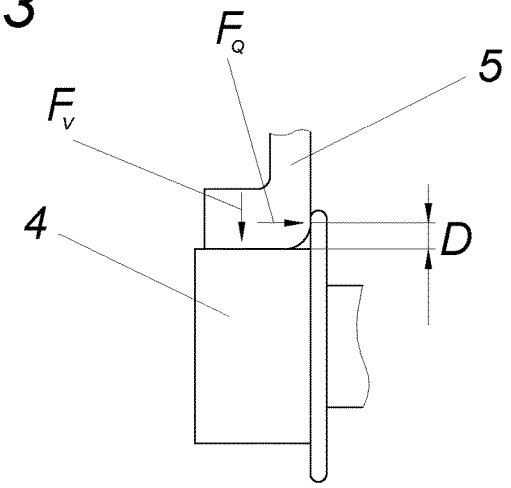
FIG. 3 shows a section with a calibration stop of FIG. 2 in an enlarged detailed view.

The calibration stop 5 rests laterally on the contact point at height D (usually 14 mm) (FIG. 3). The horizontal force $F_Q$ and the vertical force $F_V$ are acting.

Figure 4:
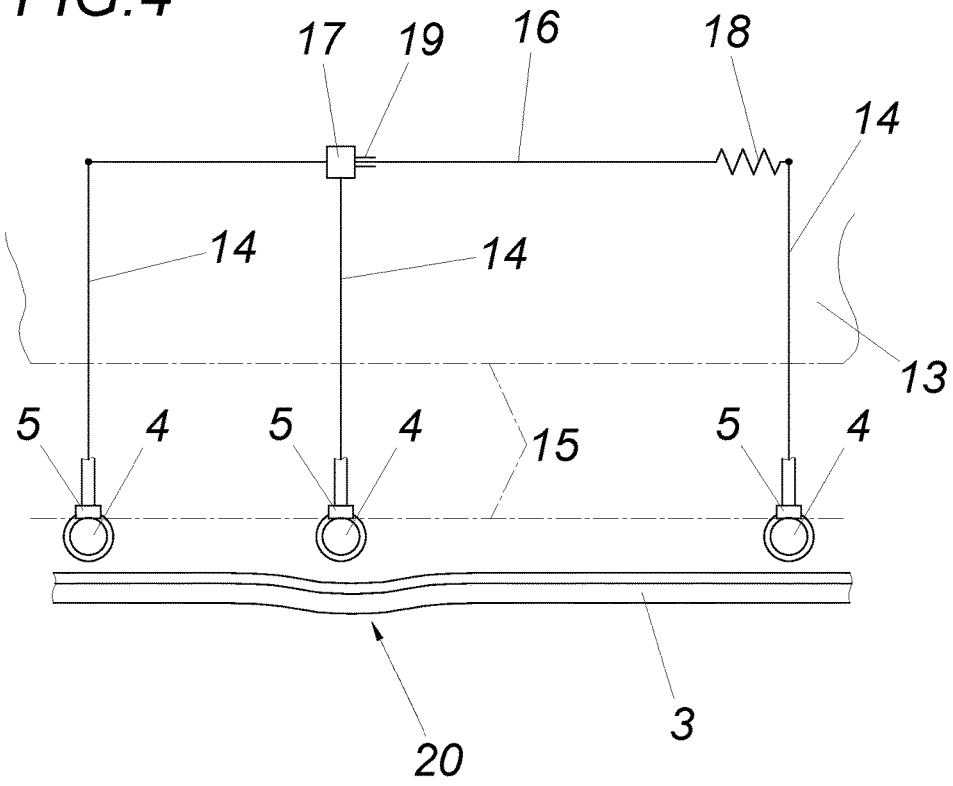
FIG. 4 shows a schematic levelling measurement system with a machine frame reference line and a calibration reference line as well as calibration stops.

FIG. 4 schematically shows the levelling system which consists of the levelling rods 14, the levelling transducer 17, the carrier 19, the levelling cord 16, a cord tensioning apparatus 18 and the measuring car 4. The reference line 15 of the absolute zero calibration apparatus in accordance with the invention lies parallel to the machine reference line 15. The wheels 4 are pressed with respect to height against the calibration stops 5. A track error 20 shows that the calibration with the measuring car 4 lowered onto the track 3 would be erroneous.

Figure 5:
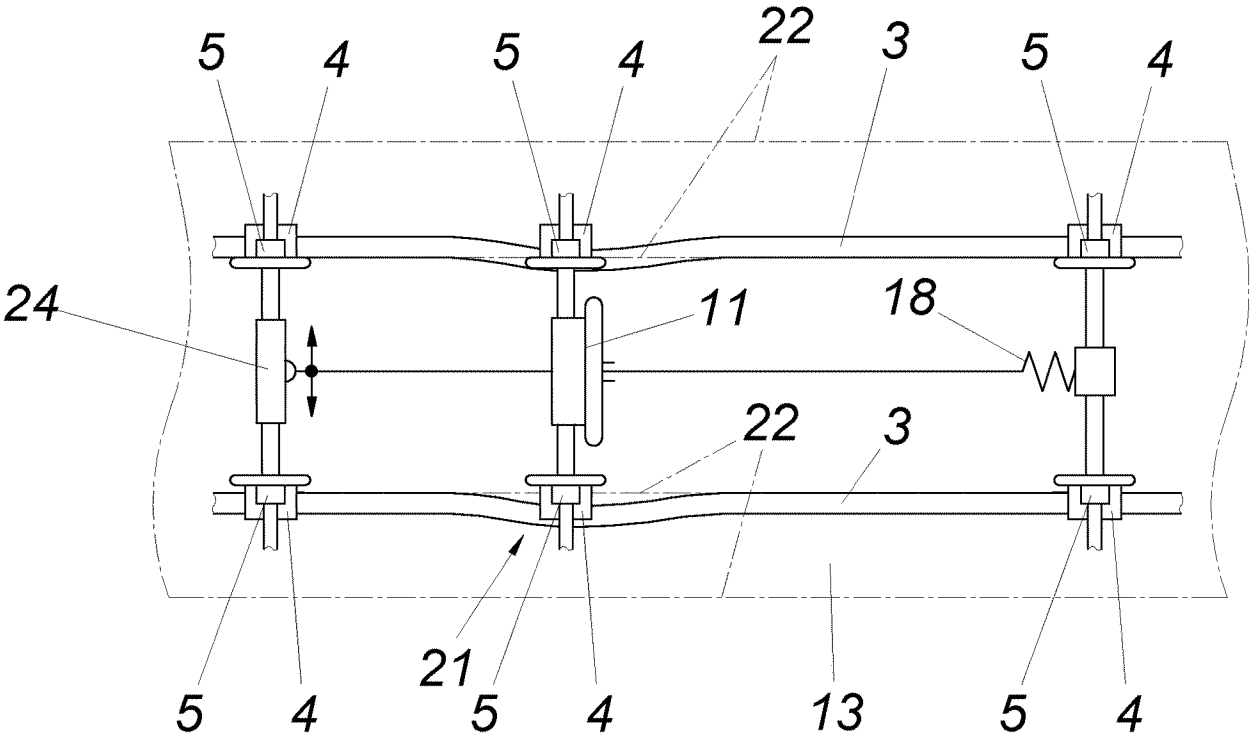
FIG. 5 shows the schematic lining measurement system with the machine reference line and the calibration reference line, as well as a calibration stops to the left and the right of the machine frame.

FIG. 5 schematically shows the embodiment in accordance with the invention of the absolute zero calibration for the lining measurement system. The measuring wheels 4 at the top are pressed against the calibration stops 5. The reference lines of the calibration device (dot-dash lines) are parallel to the machine reference line 22. Reference numeral 24 shows a mechanical lateral cord adjusting device which can be used for scale factor determination. The lining transducer 11 is installed on the middle measuring car 4, which transducer measures the lateral deflection of the lining cord 12. The lining cord 12 is tensioned by a tensioning apparatus 18. If the zero calibration were carried out with the measuring car 4 lowered onto the track 3, then it would be determined erroneously by the track error 21.

The invention claimed is:

1. A method for calibrating a device for measuring tracks having at least one track-driveable track-measuring car associated with a lifting and lining device, and comprising track-position measurement sensors configured to measure a height position, a direction and a superelevation of rails of the track using a machine frame as a reference zero line, wherein a measuring-car lifting and lowering device is associated with the track-measuring car, said method comprising:

providing a calibration device associated with the machine frame, lowering the track-measuring car, for the purpose of calibrating the track-position measurement sensors, from a parking position, in which the track-measuring car is lifted from the track, onto the track or into an intermediate position, moving calibration stops by an actuator from an idle position into a calibration position, raising and applying the track measuring car against the calibration stops, reading out resulting values of the track-position measurement sensors, reading the resulting values into the measurement system and storing the resulting values as calibration values, and lowering the track-measuring car onto the track.

2. A method according to claim 1, wherein the track-measuring car, in the calibrating position, is pressed in a first step on a machine frame side in a direction of a transverse axis of the track-measuring car via a pressing apparatus with a wheel flange against the associated calibration stop and wherein the track-position measurement sensors include a standard value measuring sensor and a levelling value measuring sensor produce respective resulting measurement values each of which is read into and stored in the measuring system as a zero calibration value for said machine frame side, and wherein the track-measuring car is subsequently pressed in a second step on an opposite machine frame side in an opposite direction opposite to said direction of the transverse axis of the track-measuring car via the pressing apparatus with another wheel flange against the associated calibration stop; and wherein another resulting measurement value on the standard value measuring sensor is read into and stored in the measuring system as a zero calibration value for said opposite machine frame side.

3. A method according to claim 1, wherein the value of the reference superelevation measured value measured on the machine frame is associated with the actual superelevation measured value measured during calibration on the measuring car.

4. A method according to claim 1, wherein the method steps are carried out in an automated manner by a control program.

5. A device for measuring tracks, said device comprising:

at least one track-driveable track-measuring car associated with a lifting and lining device, and track-position measurement sensors measuring a height position, and superelevation of the rails of the track using a machine frame as a reference zero line, wherein a measuring-car lifting and lowering device is associated with the track-measuring car, wherein the machine frame is associated with a calibration device with calibration stops, which are movable from an idle position to a calibration position by an actuator used when calibrating the track-position measurement sensors, and the track-measuring car engaging against said calibration stops when the track-measuring car is raised after the track-measuring car is moved onto the track from a parking position lifted from the track or lowered into an intermediate position, and wherein the calibration stops form attachment points for the measuring car applied by the measuring-car lifting and lowering apparatus against the calibration stops.

6. A method according to claim 1, wherein, after said lowering of the track-measuring car onto the track, the actuator moves the calibration stops from the calibration position thereof to the idle position thereof.

* * * * *